US006145353A

United States Patent [19]

Doucet

[11] Patent Number: 6,145,353

[45] Date of Patent: Nov. 14, 2000

[54] ELECTRONICALLY ACTIVATED DOOR LOCK ASSEMBLY

[75] Inventor: Christian Doucet, Otterburn Park, Canada

[73] Assignee: Unican Electronics, Quebec, Canada

[21] Appl. No.: 09/241,692

[22] Filed: Feb. 2, 1999

[51] Int. Cl.[7] ..... E05B 47/00

[52] U.S. Cl. ..... 70/277; 70/149; 70/283; 70/472

[58] Field of Search ..... 70/277, 149, 472, 70/107, 280–283, 133–134, 278.7, 278.1, 224, 219; 292/336.3, 336.5, 169.15, 169.14

[56] References Cited

U.S. PATENT DOCUMENTS

| | | | |
|---|---|---|---|
| 4,148,092 | 4/1979 | Martin | 70/149 |
| 4,820,330 | 4/1989 | Lin | 70/277 |
| 4,843,851 | 7/1989 | Frolov | 70/277 |
| 4,995,248 | 2/1991 | Liu | 70/283 |
| 5,010,752 | 4/1991 | Lin | 70/472 |
| 5,027,629 | 7/1991 | Liu | 70/277 |
| 5,544,507 | 8/1996 | Lin | 70/277 |
| 5,715,715 | 2/1998 | Nunez | 70/283 |
| 5,884,515 | 3/1999 | Milman | 70/472 |
| 5,920,268 | 7/1999 | Bucci et al. | 70/472 |

FOREIGN PATENT DOCUMENTS

| | | | |
|---|---|---|---|
| 2262770 | 6/1993 | United Kingdom | 70/283 |
| 92/07156 | 4/1992 | WIPO | 70/283 |

*Primary Examiner*—Darnell Boucher
*Attorney, Agent, or Firm*—Hill & Simpson

[57] ABSTRACT

A door lock assembly which includes an electronic card reader is provided whereby when the clutch assembly is in the activated position, rotational movement of the outside handle is transmitted by way of a spindle through the mortise and through the clutch assembly to a clutch disk disposed between the mortise and clutch assemblies and the inside housing. The clutch disk is disposed inside the door. Rotational movement of the clutch disk is then imparted back towards the door through a drive disk and hub drive to the mortise latch hub which is disposed in the mortise housing disposed inside the door structure. As a result, the clutch disk and clutch assembly can be disposed between the inside housing and the inside door surface and the electronic components of the card reader and clutch assembly can be conveniently housed in the inside housing assembly. An additional spacer hub is disposed between the outside housing and the mortise latch hub which makes it difficult to tamper with the mortise latch hub from the outside of the door.

19 Claims, 6 Drawing Sheets

ELECTRONICALLY ACTIVATED DOOR LOCK ASSEMBLY

FIELD OF THE INVENTION

The present invention relates generally to door locks and, more specifically, to electronically activated door locks. Still more specifically, the present invention relates to door lock assemblies that include a card reader that activates a clutch assembly thereby enabling the door to be opened.

BACKGROUND OF THE INVENTION

Door locks with clutches activated by electronic card readers are known. These types of door locks are particularly useful for hotels and motels because the magnetic card, which serves as a key for the lock, can be easily changed. When hotel and motel guests lose the card, the card can be easily replaced with a new magnetic code and therefore a new "combination". These types of locks are also useful for any situation where it is desirable to change the lock code or combination frequently. The magnetic cards are far cheaper to fabricate and change than conventional metal keys and tumblers.

A typical lock with an electronic card reader includes an exterior housing that includes the electronic card reader. The exterior housing is connected to an outside handle that, in turn, is connected to a spindle that extends through the housing to a clutch assembly and mortise assembly. Once an appropriately coded magnetic card is passed through the card reader, the clutch assembly is activated thereby imparting rotation from the spindle to the mortise assembly.

Problems have evolved with the above-described design. Specifically, an unwanted intruder can break the lock by removing the outside housing which enables the intruder to obtain access to either the clutch assembly or the mortise latch hub of the mortise assembly. These two parts are typically protected only by the outside housing or an additional metallic plate disposed between the outside housing and the mortise and clutch assemblies. However, the additional metal plate can be easily removed once the outside housing has been removed.

Further, removal of the outside housing also provides access to the electronic components of the card reader which, in turn, control the operation of the clutch assembly.

Therefore, if an intruder removes the outside housing, it is highly likely that the circuit board that controls the operation of the card reader and clutch assembly will be damaged.

Therefore, there is a need for an improved door lock assembly that includes an electronic card reader that provides greater protection for the electronic components that control the operation of the card reader and clutch as well as improved protection for the mortise latch hub and clutch assembly. By providing improved protection for these components, a door lock assembly that incorporates a card reader will provide improved security.

SUMMARY OF THE INVENTION

The present invention satisfies the aforenoted needs by providing a door lock assembly that comprises an outside spindle that operatively connects an outside handle to a clutch disk. The outside spindle passes through a mortise assembly and a clutch assembly without operatively engaging either the mortise or clutch assemblies. The mortise assembly is disposed between the outside handle and the clutch disk; the clutch assembly is disposed between the mortise assembly and the clutch disk. The outside spindle further passes through a drive disk without operatively engaging the drive disk.

The drive disk is disposed between the clutch assembly and the clutch disk. The clutch assembly is movable between activated and deactivated positions. When the clutch assembly is in the activated position, the clutch assembly operatively connects the clutch disk to the drive disk. The clutch disk rotates freely without operatively engaging the drive disk when the clutch assembly is in the deactivated position. The drive disk is operatively connected to the mortise assembly.

Therefore, when the outside handle is turned after the clutch assembly has been activated, rotation is imparted through the outside spindle to the clutch disk which, when the clutch assembly is in the activated position, imparts rotation to the drive disk which, in turn, imparts rotation to the mortise assembly thereby opening the door. When the clutch is in the deactivated position, the outside spindle and clutch disk rotate without imparting rotation to the drive disk and mortise assemblies thereby resulting in no action at the mortise assembly.

The rotational movement generated by rotating the outside handle when the clutch assembly is activated proceeds from the outside, i.e. at the outside handle, to the inside of the door, i.e. to the clutch disk which is disposed on an opposing side of the mortise assembly from the outside handle, back towards the outside of the door lock assembly, i.e. from the clutch disk to the drive disk to the mortise assembly. This outside to inside to outside rotational movement sequence provides a number of advantages. First, by placing the clutch disk and clutch assembly opposite the mortise assembly from the outside handle, and therefore the outside housing, the clutch disk and clutch assemblies are protected by the bulky and solid structure of the mortise assembly. Further, by placing the clutch disk and clutch assembly opposite the mortise assembly from the outside handle, the present inventors have conveniently located the circuit board required to operate the electronic card reader and clutch assembly on the inside housing, away from the outside housing. Locating the electronic component towards the inside of the door provides greater protection for those components in the event an intruder tampers with the outside housing of the door lock.

In an embodiment, the outside spindle also passes through a spacer hub disposed between the mortise assembly and the outside handle. The spacer hub provides additional protection for the mortise assembly and protects against efforts to tamper with the mortise latch hub.

In an embodiment, the outside spindle further passes through a hub drive which is disposed between the drive disk and the mortise assembly. The hub drive operatively connects the drive disk to the mortise assembly.

In an embodiment, the door lock assembly further comprises an inside handle operatively connecting a drive plate to an inside handle. The drive plate is operatively connected to the drive disk. Accordingly, rotation of the inside handle imparts rotation to the drive plate which, in turn, imparts rotation to the drive disk which, in turn, is operatively connected to the mortise assembly as discussed above. Therefore, rotation of the inside handle always results in an opening of the door.

In an embodiment, the mortise assembly comprises a mortise latch hub. The outside spindle passes through the mortise latch hub without operatively engaging the mortise latch hub. The mortise latch hub is operatively connected to a latch and to the drive disk.

In an embodiment, the outside spindle also passes through a spacer hub disposed between the mortise latch hub and the outside handle.

In an embodiment, the clutch assembly is activated by an electronic card reader.

In an embodiment, the clutch assembly comprises a motor drive connected to an engaging piece. The engaging piece is biased away from the clutch disk when the clutch assembly is deactivated. When the clutch assembly is activated, the motor drive moves the engaging piece into operative engagement with the clutch disk and the drive disk so that the engaging piece operatively connects the clutch disk to the drive disk.

In an embodiment, the door lock assembly further comprises an inside spindle that operatively connects a drive plate to an inside handle. The drive plate is operatively connected to the drive disk so that rotation of the inside handle results in rotation of the drive disk which, in turn, imparts the rotational movement to the mortise assembly.

In an embodiment, the door lock assembly comprises an outside housing and an inside housing. The mortise assembly is disposed between the outside housing and the clutch assembly and the clutch assembly is disposed between the mortise assembly and the inside housing. The inside housing also further includes a space for mounting a circuit board which operates the card reader and clutch assembly.

It is therefore an advantage of the present invention to provide an improved door lock assembly that utilizes an electronic card reader.

Still another advantage of the present invention is that it provides a door lock assembly with improved security features.

Yet another advantage of the present invention is that it provides an improved electronic door lock assembly whereby the circuit board that drives the card reader and clutch assembly is disposed inside the inside housing of the door lock assembly as opposed to adjacent to the outside housing of the door lock assembly.

Yet another advantage of the present invention is that it provides an improved door lock assembly with a spacer hub disposed in front of the mortise latch hub which makes it more difficult to tamper with the mortise latch hub in the event the outside housing is removed.

Still another advantage of the present invention is that it provides an improved door lock assembly whereby the clutch assembly is disposed on an opposing side of the mortise assembly from the outside housing.

Another advantage of the present invention is that it provides an improved weather resistance for the lock assembly as the clutch, the electronic board and the batteries are on the inside, so not exposed to various weather conditions (rain, low temperature, snow, . . . ).

Still another advantage of the present invention is that it provides an improved door lock assembly with a clutch disk and clutch assembly disposed on an opposing side of the mortise assembly from the outside housing and outside handle.

Other advantages and objects of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiment illustrated in greater detail in the accompanying drawings and described below by way of an example of the present invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
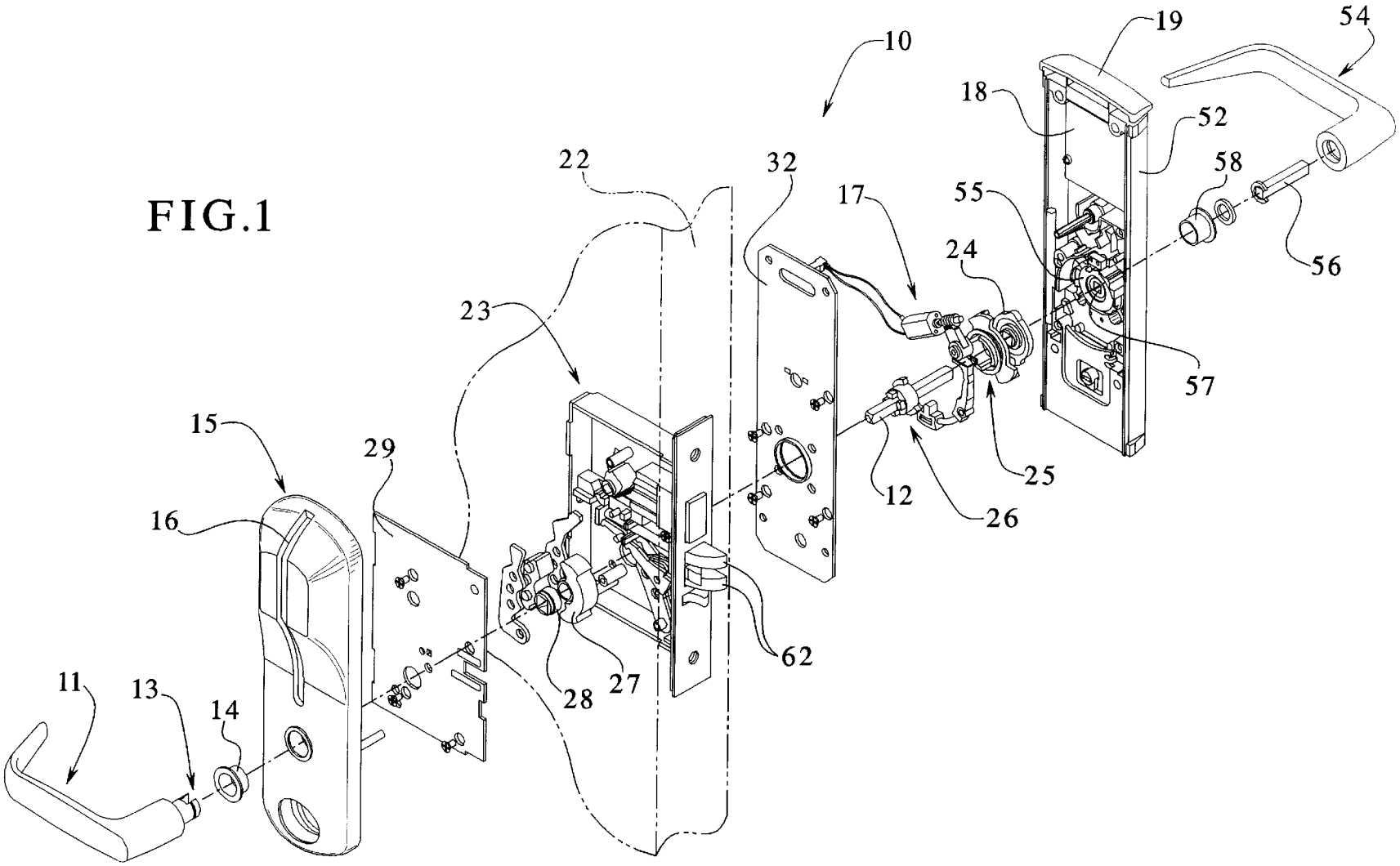
FIG. 1 is an exploded view of a door lock assembly made in accordance with the present invention.

Turning first to FIG. 1, an exploded view of the door lock assembly 10 is provided. The door lock assembly 10 includes an outside handle 11 which is operatively connected to the outside spindle 12 by way of insertion of the outside spindle 12 into the shaped fitting 13 of the handle 11. A bushing 14 is disposed between the handle 11 and the outside housing 15. The outside housing 15 includes a slot 16 for passing a magnetic card therethrough for purposes of opening the door lock assembly 10. The details of the operation of the card reader (not shown) and clutch assembly 17 mechanisms will not be discussed in detail as these components are known to those skilled in the art. It will be noted, however, that a printed circuit board (not shown) is used to operate the card reader (not shown) as well as the clutch assembly 17. Space for a printed circuit board (not shown) is provided in the area 18 of the inside housing assembly 19. Thus, the printed circuit board is disposed inside the door 22.

Figure 4:
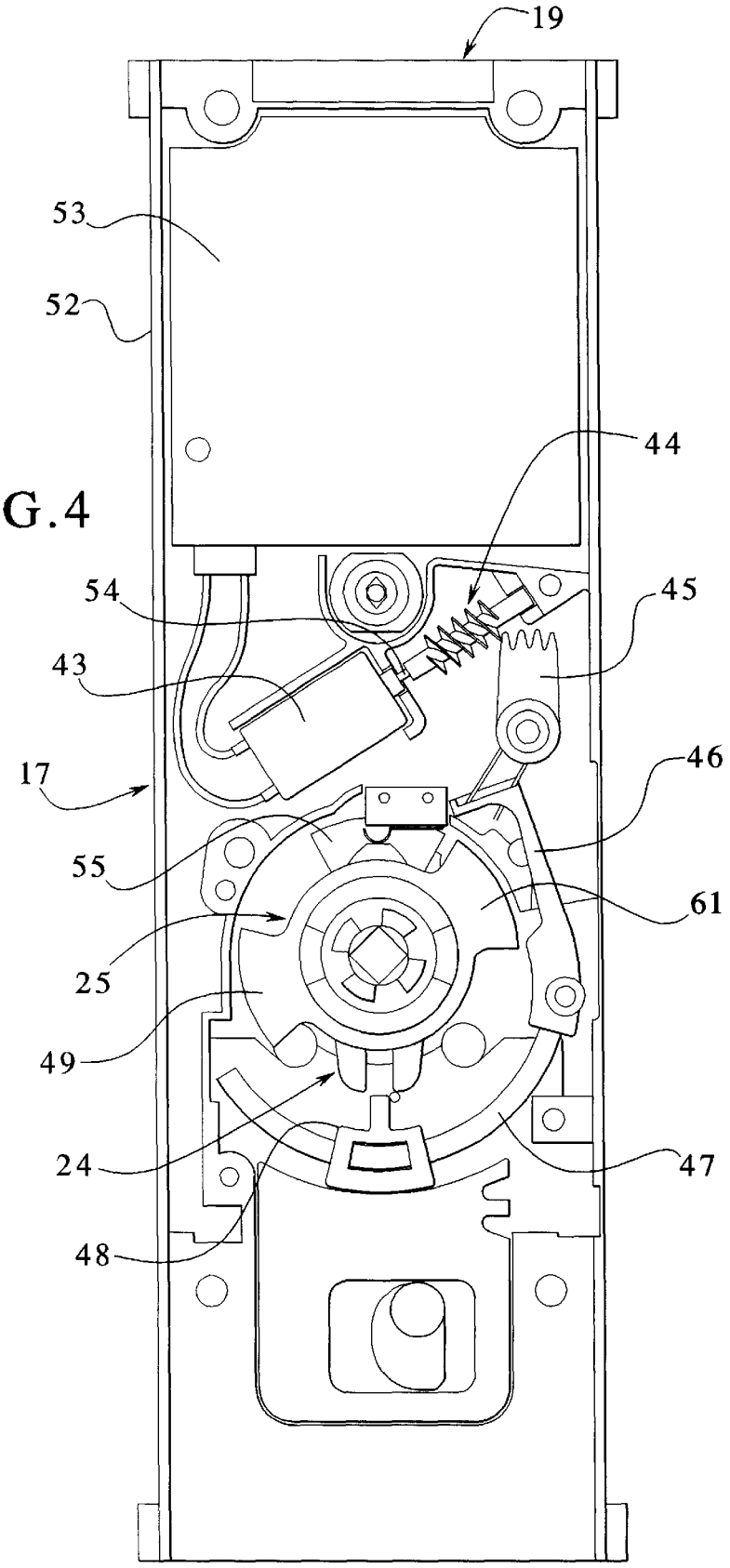
FIG. 4 is a front plan view of the inside housing and clutch assembly of the door lock assembly shown in FIG. 1, wherein the clutch assembly is in the deactivated position.
Figure 5:
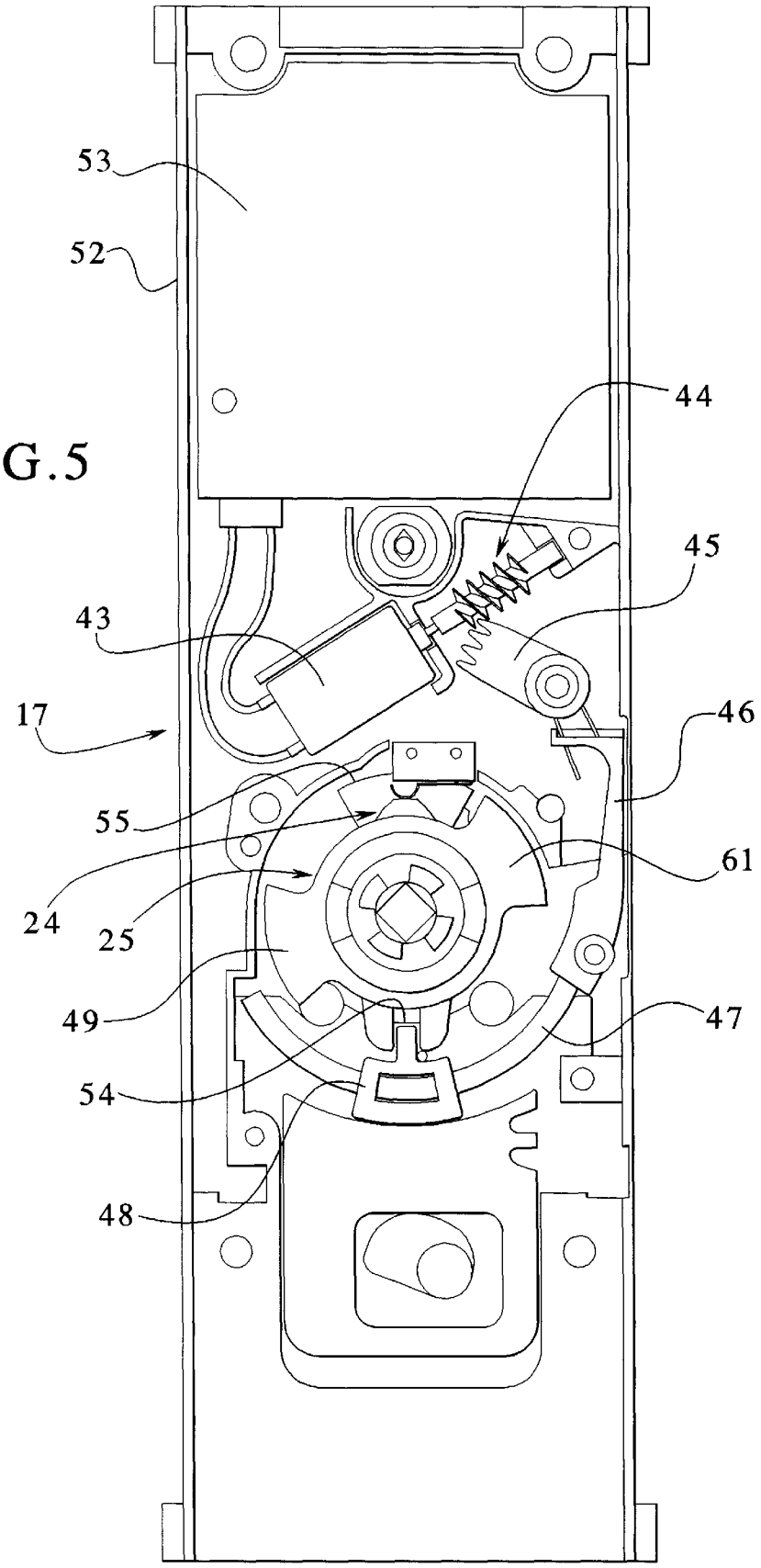
FIG. 5 is another plan view of the inside housing and clutch assembly of the door lock assembly shown in FIG. 1, wherein the clutch assembly is in the activated position.

The outside spindle 12 passes through the mortise assembly 23 as well as the clutch assembly 17 without operatively engaging either. Rotational movement of the outside handle 11 is transmitted through the outside spindle 12 directly to the clutch disk 24. The spindle 12 is free to rotate within the drive disk 25, hub drive 26, mortise latch hub 27 and mortise spacer hub without operatively engaging any of these components. Therefore, rotational movement of the outside handle 11 is transmitted through the outside spindle 12 to an inside component, specifically the clutch disk 24. When the clutch assembly 17 is in the activated position as illustrated in FIG. 5, rotation of the clutch disk 24 is transmitted to the drive disk 25. When the clutch assembly 17 is in the deactivated position as shown in FIG. 4, rotation of the clutch disk 24 does not result in rotation of the drive disk 25. Therefore, when the clutch assembly 17 is deactivated (i.e. an appropriate magnetic card has not been passed through the slot 16), rotation of the outside handle 11 results in rotation of the clutch disk 24 only and no rotational movement is imparted back to the mortise assembly 23.

However, when the clutch assembly 17 is in the activated position (see FIG. 5), the clutch disk 24 is operatively connected to the drive disk 25 and rotational movement of the clutch disk 24 is imparted to the drive disk 25. The drive disk 25 is coupled to the hub drive 26 which, in turn, rotates as the drive disk 25 is rotated. The hub drive 26 is coupled to the mortise latch hub 27. Accordingly, when the hub drive 26 is rotated, the mortise latch hub 27 is rotated and the mortise 23 is opened. The detailed operation of the mortise assembly 23 will not be discussed as its operation and configuration, other than the mortise latch hub 27 and spacer hub 28, is known to those skilled in the art.

Therefore, when the clutch assembly 17 is activated, rotational movement of the handle 11 is transferred through the outside spindle 12 to the clutch disk 24, which is mounted in the inside housing 19 (see FIGS. 4 and 5) and, back outside through the drive disk 25, hub drive 26 to the mortise latch hub 27. This outside to inside and then back outside transmission path of rotational movement of the outside handle 11 enables the clutch disk 24 and clutch assembly 17 to be disposed behind the mortise assembly 23 or between the mortise assembly 23 and the inside housing 19. By enabling the clutch assembly 17 to be mounted between the mortise assembly 23 and the inside housing 19, the electronic components that operate the card reader and clutch assembly 17 may be easily mounted in the space shown at 18. The inside housing 19 is also an appropriate place for the mounting of batteries to operate the system.

Still referring to FIG. 1, the mortise assembly 23 includes a cover plate 29 which provides a certain degree of protection for the mortise latch hub 27. However, the placement of the spacer hub 28 between the outside handle 11 and the mortise latch hub 27 provides additional protection for the mortise latch hub 27 and makes it difficult for an intruder to tamper with the mortise latch hub 27. The inside housing 19 is also fitted with a protective cover plate 32 which provides protection for the clutch assembly 17 and clutch disk 24. Further, if an intruder were to remove the outside housing 15, it would be difficult and time consuming to obtain access to the clutch assembly 17 and electronic components stored in the space 18 of the inside housing 19. Thus, the door lock assembly 10 is extremely tamper resistant.

Figure 2:
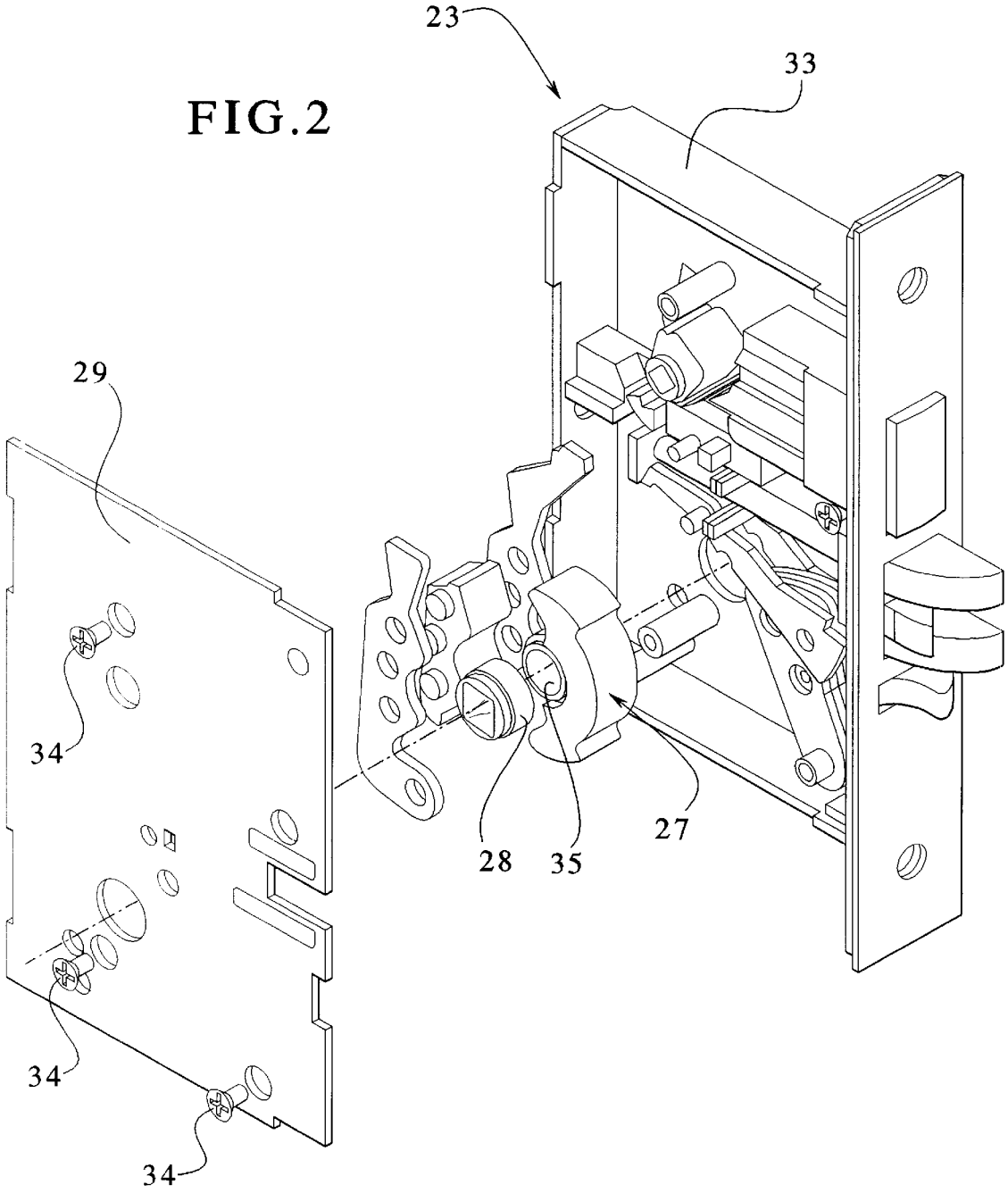
FIG. 2 is an exploded view of the mortise assembly of the door lock assembly shown in FIG. 1.
Figure 6:
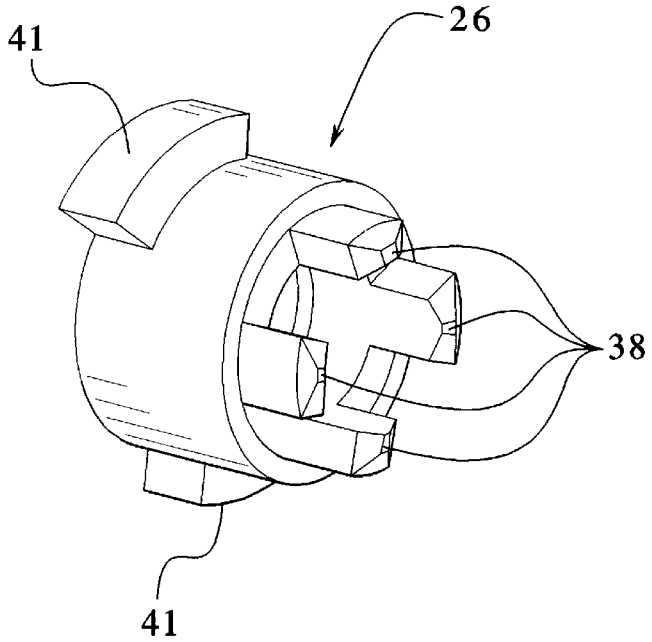
FIG. 6 is a perspective view of the hub drive of the door lock assembly shown in FIG. 1.
Figure 7:
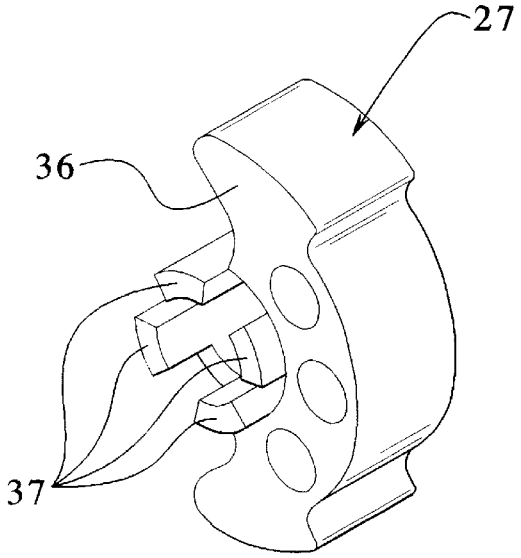
FIG. 7 is a rear perspective view of the mortise latch hub of the door lock assembly shown in FIG. 1.
Figure 8:
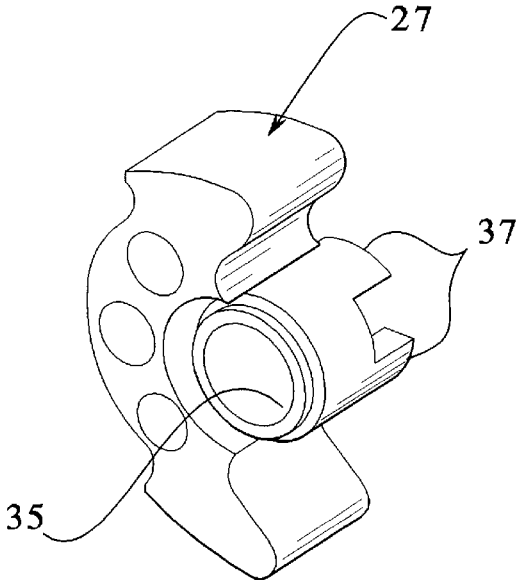
FIG. 8 is a front perspective view of the mortise latch hub of the door lock assembly shown in FIG. 1.

Turning to FIG. 2, the mortise assembly 23 is illustrated in greater detail. The mortise housing 33 is connected to the cover plate 29 with a plurality of screws 34, the central opening 35 of the mortise latch hub 27 is sufficiently wide to loosely accommodate the outside spindle 12 (see FIG. 1). Thus, rotation of the spindle 12 does not result in rotation of the mortise latch hub 27. Instead, the rear side 36 of the mortise latch hub 27 (see FIG. 7) includes a plurality of spaced apart teeth 37 which mesh with the teeth 38 of the hub drive 26 (see FIG. 6). Still referring to FIG. 6, it will be noted that the sectors 41 are received in the slots 42 of the drive disk 25 (see FIG. 3) so that rotation of the drive disk 25 results in rotation of the hub drive 26.

Figure 3:
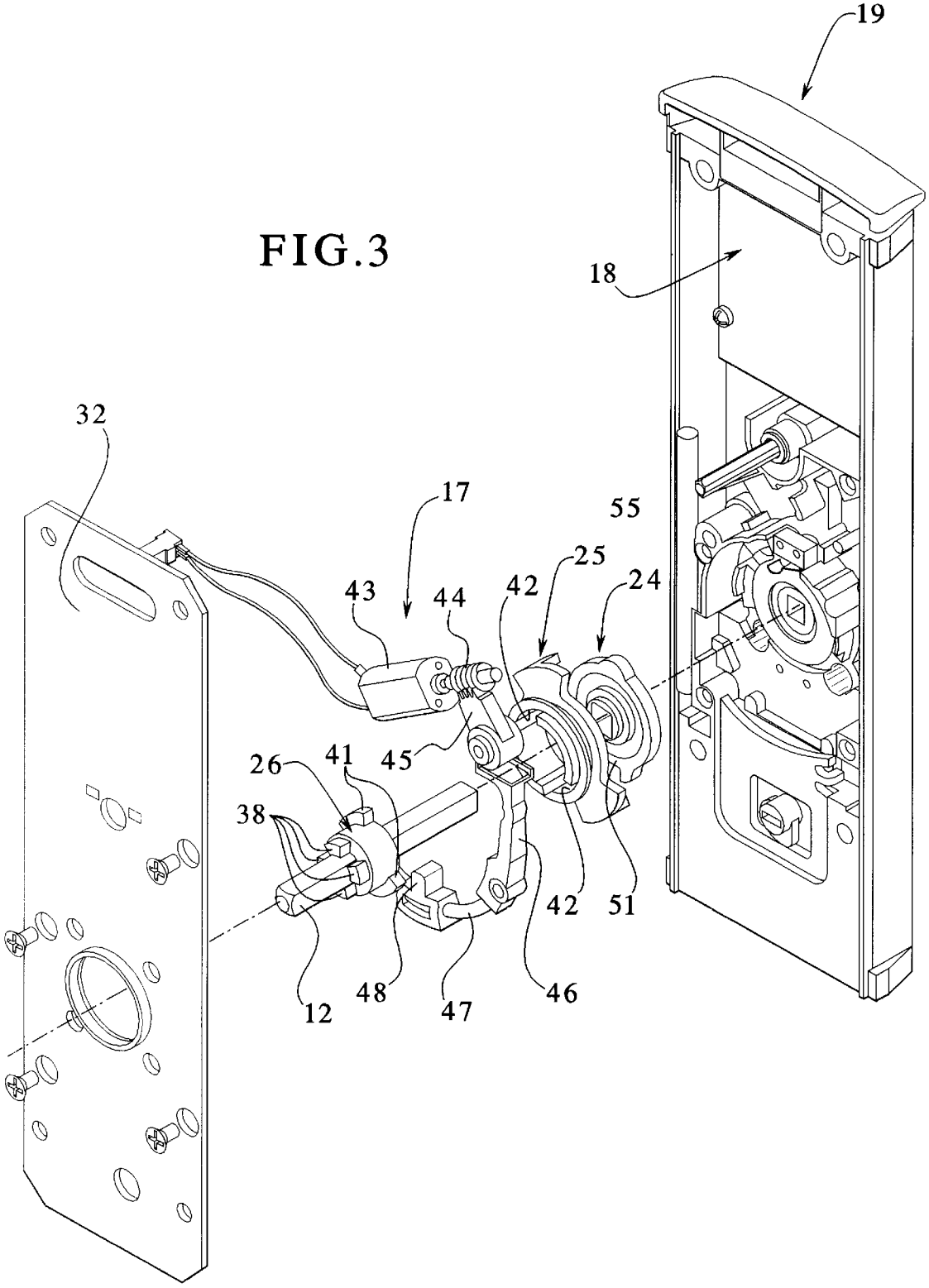
FIG. 3 is an exploded view of the clutch assembly and inside housing of the door lock assembly shown in FIG. 1.

Still referring to FIG. 3, it will be noted that the clutch assembly 17 includes a motor 43 which is connected to a worm gear 44 which is meshed with a sector gear 45. The sector gear 45 converts rotational movement of the worm gear 44 to pivotal movement of the pivot guide element 46 and guide rod 47. The guide rod 47 is connected to an engaging piece 48 which is received in the recess 51 of the clutch disk 24 as better shown in FIGS. 4 and 5.

Turning to FIG. 4, the inside housing assembly includes a housing structure 52 which houses an electronic circuit board shown schematically at 53 as well as the clutch assembly 17 and clutch disk 24. The motor 43 is controlled by the circuit board 53. Rotation of the motor shaft 54 results in rotation of the worm gear 44 which, in turn, imparts pivotal movement to the guide element 46 by way of the sector gear 45. Movement of the sector gear 45 towards the motor 43 as shown in FIG. 5 results in upward pivotal movement of the guide rod 47 and engaging element 48 as shown in FIG. 5. With the engaging element 48 accommodated in the recess 51 of the clutch disk 24, rotation of the clutch disk 24 in the clockwise direction as shown in FIG. 5 will result in the engaging element 48 striking the ear 49 of the drive disk 25 and imparting clockwise rotation to the drive disk 25. Of course, the rotation could be counter clockwise as well. Thus, only when the clutch assembly 17 is in the activated position shown in FIG. 5 is rotational movement of the clutch disk 24 imparted to the drive disk 25. In its position shown in FIG. 4, no rotational movement of the clutch disk 24 is imparted to the drive disk 25.

Returning to FIG. 1, an inside handle 54 is also provided which is connected to the drive plate 55, which is also shown in FIGS. 4 and 5, by way of the inside spindle 56. The drive plate 55 includes a square hole 57 for accommodating the inside spindle 56. A bushing 58 is also provided between the handle 54 and housing structure 52. Accordingly, rotation of the inside handle 54 and inside spindle 56 imparts rotational movement to the drive plate 55. Referring to either FIGS. 4 or 5, clockwise rotation of the drive plate 55 results in engagement with the ear 61 of the drive disk 25. Because the drive plate 55 always engages the drive disk 25 regardless of the position of the clutch assembly 17, rotation of the inside handle 54 always results in rotation of the drive disk 25 which, in turn, as discussed above, results in rotational movement imparted to the hub drive 26 and mortise latch hub 27 which results in a retraction of the latch bolt 62.

From the above description, it is apparent that the advantages and objects of the present invention have been achieved. While only certain embodiments have been set forth, alternative embodiments and various modifications will be apparent from the above description to those skilled in the art.

What is claimed is:

1. A door lock assembly comprising:

an outside spindle operatively connecting an outside handle to a clutch disk, the outside spindle passing through a mortise assembly and a clutch assembly without operatively engaging either the mortise or clutch assemblies, the mortise assembly being disposed between the outside handle and the clutch disk, the outside spindle further passing though a drive disk without operatively engaging the drive disk, the drive disk being disposed between the mortise assembly and the clutch disk, the clutch assembly having activated and deactivated positions, the clutch assembly operatively connecting the clutch disk to the drive disk when the clutch assembly is in the activated position, the clutch disk being rotatable without operatively engaging the drive disk when the clutch assembly is in the deactivated position, the drive disk being operatively connected to the mortise assembly, the door lock assembly further comprising an inside spindle operatively connecting a drive plate to an inside handle, the drive plate operatively engaging the drive disk.

2. The door lock assembly of claim 1 wherein the outside spindle further passes through a hub drive, the hub drive being disposed between the drive disk and the mortise assembly, the hub drive operatively connecting the drive disk to the mortise assembly.

3. The door lock assembly of claim 1 wherein the outside spindle also passes through a spacer hub disposed between the mortise assembly and the outside handle.

4. The door lock assembly of claim 1 wherein the mortise assembly comprises mortise latch hub, the outside spindle passing through the mortise latch hub without operatively engaging the mortise latch hub, the mortise latch hub being operatively connected to a latch and to the drive disk.

5. The door lock assembly of claim 4 wherein the outside spindle also passes through a spacer hub disposed between the mortise latch hub and the outside handle.

6. The door lock assembly of claim 1 wherein the clutch assembly is activated by an electronic card reader.

7. The door lock assembly of claim 1 wherein the clutch assembly comprises a motor drive connected to an engaging piece, the engaging piece being biased away from the clutch disk when the clutch assembly is deactivated, when the clutch assembly is activated, the motor drive moving the engaging piece into operative engagement with the clutch disk and the drive disk so that the engaging piece operatively connects the clutch disk to the drive disk.

8. A door lock assembly comprising:

an outside spindle operatively connecting an outside handle to a clutch disk, the outside spindle passing through a mortise assembly and a clutch assembly without operatively engaging either the mortise or clutch assemblies, the mortise assembly being disposed between the outside handle and the clutch disk, the outside spindle further passing through a drive disk without operatively engaging the drive disk, the drive disk being disposed between the mortise assembly and the clutch disk, the clutch assembly having activated and deactivated positions, the clutch assembly operatively connecting the clutch disk to the drive disk when the clutch assembly is in the activated position, the clutch disk being rotatable without operatively engaging the drive disk when the clutch assembly is in the deactivated position, the outside spindle further passes through a hub drive, the hub drive being disposed between the drive disk and the mortise assembly, the hub drive operatively connecting the drive disk to the mortise assembly, the door lock assembly further comprising an inside spindle operatively connecting a drive plate to an inside handle, the drive plate being operatively engaging the drive disk.

9. The door lock assembly of claim 8 wherein the outside spindle also passes through a spacer hub disposed between the mortise assembly and the outside handle.

10. The door lock assembly of claim 8 wherein the mortise assembly comprises mortise latch hub, the outside spindle passing through the mortise latch hub without operatively engaging the mortise latch hub, the mortise latch hub being operatively connected to a latch, the hub drive operative connecting the drive disk to the mortise latch hub.

11. The door lock assembly of claim 10 wherein the outside spindle also passes through a spacer hub disposed between the mortise latch hub and the outside handle.

12. The door lock assembly of claim 8 wherein the clutch assembly is activated by an electronic card reader.

13. The door lock assembly of claim 8 wherein the clutch assembly comprises a motor drive connected to an engaging piece, the engaging piece being biased away from the clutch disk when the clutch assembly is deactivated, when the clutch assembly is activated, the motor drive moving the engaging piece into operative engagement with the clutch disk so that the engaging piece operatively connects the clutch disk to the drive disk.

14. A door lock assembly comprising:

an outside housing assembly and an inside housing assembly with a mortise assembly and clutch assembly disposed therebetween with the clutch assembly being disposed between the mortise assembly and the inside housing assembly, the outside housing comprising an electronic card reader, the outside housing being connected to an outside handle, the outside handle being connected to an outside spindle that connects the outside handle to a clutch disk, the outside spindle passing through a mortise assembly and a clutch assembly without operatively engaging the mortise or clutch assemblies, the outside spindle further passing through a drive disk without operatively engaging the drive disk, the drive disk being disposed between the mortise assembly and the clutch disk, the clutch assembly having activated and deactivated positions, the clutch assembly being switched between the deactivated position and the activated position by an electronic card reader, the clutch assembly operatively connecting the clutch disk to the drive disk when the clutch assembly is in the activated position, the clutch disk being rotatable without operatively engaging the drive disk when the clutch assembly is in the deactivated position, the outside spindle further passes through a hub drive, the hub drive being disposed between the drive disk and the mortise assembly, the hub drive operatively connecting the drive disk to the mortise assembly, the door lock assembly further comprising an inside spindle operatively connecting a drive plate to an inside handle, the drive plate being operatively engaging the drive disk.

15. The door lock assembly of claim 14 wherein the outside spindle also passes through a spacer hub disposed between the mortise assembly and the outside handle.

16. The door lock assembly of claim 14 wherein the mortise assembly comprises mortise latch hub, the outside spindle passing through the mortise latch hub without operatively engaging the mortise latch hub, the mortise latch hub being operatively connected to a latch, the hub drive operative connecting the drive disk to the mortise latch hub.

17. The door lock assembly of claim 16 wherein the outside spindle also passes through a spacer hub disposed between the mortise latch hub and the outside handle.

18. The door lock assembly of claim 14 wherein the clutch assembly comprises a motor drive connected to an engaging piece, the engaging piece being biased away from the clutch disk when the clutch assembly is deactivated, when the clutch assembly is activated, the motor drive moving the engaging piece into operative engagement with the clutch disk so that the engaging piece operatively connects the clutch disk to the drive disk.

19. The door lock assembly of claim 14 wherein the electronic card reader is connected to a circuit board, the circuit board being connected to the inside housing assembly.

* * * * *